US009857733B2

(12) United States Patent
Matsuzaki

(10) Patent No.: US 9,857,733 B2
(45) Date of Patent: Jan. 2, 2018

(54) SEALING MEMBER HAVING A SEAL PORTION AND A SUPPORTING PORTION

(71) Applicant: CANON KABUSHIKI KAISHA, Tokyo (JP)

(72) Inventor: Hiroomi Matsuzaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/165,227

(22) Filed: May 26, 2016

(65) Prior Publication Data

US 2017/0003622 A1 Jan. 5, 2017

(30) Foreign Application Priority Data

Jun. 30, 2015 (JP) ..... 2015-132104

(51) Int. Cl.
*G03G 15/08* (2006.01)

(52) U.S. Cl.
CPC ..... *G03G 15/0898* (2013.01); *G03G 15/0817* (2013.01)

(58) Field of Classification Search
CPC ..... G03G 15/0898; G03G 15/0817
See application file for complete search history.

(56) References Cited

U.S. PATENT DOCUMENTS 5,943,529 A 8/1999 Miyabe et al.
5,966,567 A 10/1999 Matsuzaki et al.
6,011,941 A 1/2000 Takashima et al.
6,097,906 A 8/2000 Matzuzaki et al.
6,144,815 A 11/2000 Chadani et al.
6,173,140 B1 1/2001 Suzuki et al.
6,173,145 B1 1/2001 Chadani et al.
6,205,305 B1 3/2001 Suzuki et al.
6,219,504 B1 4/2001 Matsuzaki et al.
6,282,389 B1 8/2001 Matsuzaki et al.
6,405,004 B2 6/2002 Matsuzaki et al.
6,487,383 B2 11/2002 Buchanan et al.
6,549,736 B2 4/2003 Miyabe et al.
6,792,229 B2 9/2004 Matsuzaki
6,795,666 B2 9/2004 Miyabe et al.
6,931,226 B2 8/2005 Chadani et al.
6,934,485 B2 8/2005 Miyabe et al.
7,224,925 B2 5/2007 Sato et al.
7,349,657 B2 3/2008 Sato et al.
7,412,193 B2 8/2008 Sato et al.
8,867,955 B2 10/2014 Yamaguchi et al.
9,146,500 B2 9/2015 Uesugi et al.
9,152,081 B2 10/2015 Yasui et al.
9,188,906 B2 11/2015 Batori et al.
(Continued)

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

A sealing member for sealing between an accommodating container for accommodating a developer and a member to be assembled to the accommodating container includes a seal forming portion formed of an elastomer resin material or a rubber material and configured to be closely contacted to each of the accommodating container and the member; and a supporting portion for supporting the seal forming portion, wherein the supporting portion is formed of a material harder than the material of the seal forming portion and is configured to be fixed to the accommodating container.

12 Claims, 12 Drawing Sheets

(56) References Cited

U.S. PATENT DOCUMENTS

| | | | | |
|---|---|---|---|---|
| 9,207,581 | B2 | 12/2015 | Wada et al. | |
| 9,291,942 | B2 | 3/2016 | Matsuzaki et al. | |
| 9,304,439 | B2 | 4/2016 | Matsuzaki et al. | |
| 9,360,831 | B2 | 6/2016 | Matsuzaki et al. | |
| 9,529,298 | B2 * | 12/2016 | Sato | G03G 15/0812 |
| 2003/0118364 | A1 * | 6/2003 | Kamimura | G03G 15/0817 399/103 |
| 2003/0123899 | A1 * | 7/2003 | Kamimura | G03G 15/0817 399/103 |
| 2008/0112723 | A1 * | 5/2008 | Oguma | G03G 15/0898 399/104 |
| 2013/0330099 | A1 * | 12/2013 | Gutierrez | G03G 15/08 399/103 |
| 2013/0343785 | A1 | 12/2013 | Matsuzaki et al. | |
| 2014/0029974 | A1 | 1/2014 | Uesugi et al. | |
| 2014/0072346 | A1 | 3/2014 | Furutani et al. | |
| 2014/0270842 | A1 * | 9/2014 | Gonzalez | G03G 15/0898 399/103 |
| 2015/0086237 | A1 * | 3/2015 | Xu | G03G 15/0817 399/103 |
| 2015/0205226 | A1 | 7/2015 | Komatsu et al. | |
| 2016/0170330 | A1 | 6/2016 | Matsuzaki et al. | |
| 2016/0170370 | A1 * | 6/2016 | Shimizu | G03G 21/0029 399/102 |

* cited by examiner (a)

(b)

(a)

(b)

SEALING MEMBER HAVING A SEAL PORTION AND A SUPPORTING PORTION

FIELD OF THE INVENTION AND RELATED ART

The present invention relates to a sealing member in an image forming apparatus and a process cartridge.

Conventionally, in an electrophotographic image forming apparatus using an electrophotographic image forming process, a so-called process cartridge type has been employed in some cases. The process cartridge type is such a device constitution that an electrophotographic photosensitive member of a drum type (hereinafter referred to as a photosensitive drum) and process means actable on the photosensitive drum are integrally assembled as a cartridge which is constituted so as to be detachably mountable to an apparatus main assembly of the image forming apparatus. In such a process cartridge, a type in which a sealing member (seal member) is provided between a cartridge frame and an end portion of a rotatable member such as the photosensitive drum or a developing roller and thus leakage of a developer from the cartridge frame is suppressed or prevented has been widely employed. As the sealing member, those using an elastic member such as a rubber material, those using fibers such as a pile or a felt, those using a magnetic material, and the like can be used. Of these members, as an example of a seal using the elastic member, a sealing member of an elastic member provided between a rotatable member and a frame has been proposed (U.S. Pat. No. 6,487,383). In this constitution, the sealing member constituted as a single part by a single elastic material.

SUMMARY OF THE INVENTION

According to an aspect of the present invention, there is provided a sealing member for sealing between an accommodating container for accommodating a developer and a member to be assembled to the accommodating container, the sealing member comprising: a seal forming portion formed of an elastomer resin material or a rubber material and configured to be closely contacted each of the accommodating container and the member; and a supporting portion for supporting the seal forming portion, wherein the supporting portion is formed of a material harder than the material of the seal forming portion and is configured to be fixed to the accommodating container.

According to another aspect of the present invention, there is provided a unit detachably mountable to a main assembly of an image forming apparatus, comprising: an accommodating container for accommodating a developer; a developer carrying member provided rotatably relative to the accommodating container; a sealing member for sealing between the accommodating container and the developer carrying member, wherein the sealing member is formed of an elastomer resin material or a rubber material and includes a seal forming portion closely contacting each of the accommodating container and the developer carrying member and a supporting portion for supporting the seal forming portion, wherein the supporting portion is formed of a material harder than the material of the seal forming portion and is fixed to the accommodating container; and a supporting member, assembled to the accommodating container with respect to an axial direction, for rotatably supporting an end portion of a rotation shaft of the developer carrying member with respect to the axial direction and for fixing the sealing member by pressing the sealing member against the accommodating container with respect to the axial direction.

According to another aspect of the present invention, there is provided a unit detachably mountable to a main assembly of an image forming apparatus, comprising: an accommodating container for accommodating a developer; a developer carrying member provided rotatably relative to the accommodating container; a blade contacting the developer carrying member; a sealing member for sealing between the accommodating container and the blade, wherein the sealing member is formed of an elastomer resin material or a rubber material and includes a seal forming portion closely contacting each of the accommodating container and the blade and a supporting portion for supporting the seal forming portion, wherein the supporting portion is formed of a material harder than the material of the seal forming portion and is fixed to the accommodating container; and a supporting member, assembled to the accommodating container with respect to an axial direction, for rotatably supporting an end portion of a rotation shaft of the developer carrying member with respect to the axial direction and for fixing the sealing member by pressing the sealing member against the accommodating container with respect to the axial direction.

According to another aspect of the present invention, there is provided an image forming apparatus comprising: an accommodating container for accommodating a developer; a developer carrying member provided rotatably relative to the accommodating container; a sealing member for sealing between the accommodating container and the developer carrying member, wherein the sealing member is formed of an elastomer resin material or a rubber material and includes a seal forming portion closely contacting each of the accommodating container and the developer carrying member and a supporting portion for supporting the seal forming portion, wherein the supporting portion is formed of a material harder than the material of the seal forming portion and is fixed to the accommodating container; and a supporting member, assembled to the accommodating container with respect to an axial direction, for rotatably supporting an end portion of a rotation shaft of the developer carrying member with respect to the axial direction and for fixing the sealing member by pressing the sealing member against the accommodating container with respect to the axial direction.

According to a further aspect of the present invention, there is provided an image forming apparatus comprising: an accommodating container for accommodating a developer; a developer carrying member provided rotatably relative to the accommodating container; a blade contacting the developer carrying member; a sealing member for sealing between the accommodating container and the blade, wherein the sealing member is formed of an elastomer resin material or a rubber material and includes a seal forming portion closely contacting each of the accommodating container and the blade and a supporting portion for supporting the seal forming portion, wherein the supporting portion is formed of a material harder than the material of the seal forming portion and is fixed to the accommodating container; and a supporting member, assembled to the accommodating container with respect to an axial direction, for rotatably supporting an end portion of a rotation shaft of the developer carrying member with respect to the axial direction and for fixing the sealing member by pressing the sealing member against the accommodating container with respect to the axial direction.

Further features of the present invention will become apparent from the following description of exemplary embodiments with reference to the attached drawings.

DESCRIPTION OF THE EMBODIMENTS

Embodiments for carrying out the present invention will be specifically described with reference to the drawings. Dimensions, materials, shapes and relative arrangement of constituent elements described in the following embodiment should be appropriately be changed depending on structures and various conditions of devices (apparatuses) to which the present invention is applied. Accordingly, the scope of the present invention is not intended to be limited to the following embodiments.

[Embodiment 1]

The present invention relates to a developing device, a developing cartridge, a process cartridge and an image forming apparatus using those members. The developing device is a device, including a developing roller (developer carrying member) for carrying a developer on a surface thereof, for visualizing an electrostatic image formed on a photosensitive drum (image bearing member), with the developer. The developing cartridge is a cartridge prepared by integrally assembling the developing device into a cartridge (unit) and then detachably mounted to an image forming apparatus main assembly. The process cartridge is a cartridge prepared by integrally assembling the photosensitive drum and the developing device actable on the photosensitive drum into a cartridge (unit) and then detachably mounted to an image forming apparatus main assembly. Further, the image forming apparatus forms an image on a recording material (medium) by using an electrophotographic image forming method. Examples of the electrophotographic image forming apparatus may include an electrophotographic copying machine, an electrophotographic printer (LED printer, laser beam printer or the like), a facsimile machine, and a word processor, and the like.

The image forming apparatus according to Embodiment 1 of the present invention will be described with reference to FIGS. 1 to 3, 6, 11 and 12. Incidentally, in the following description, a rotational axis direction of each of a photosensitive drum 62 and a developing roller 32 provided in parallel to the drum 62 is D1.

Figure 2:
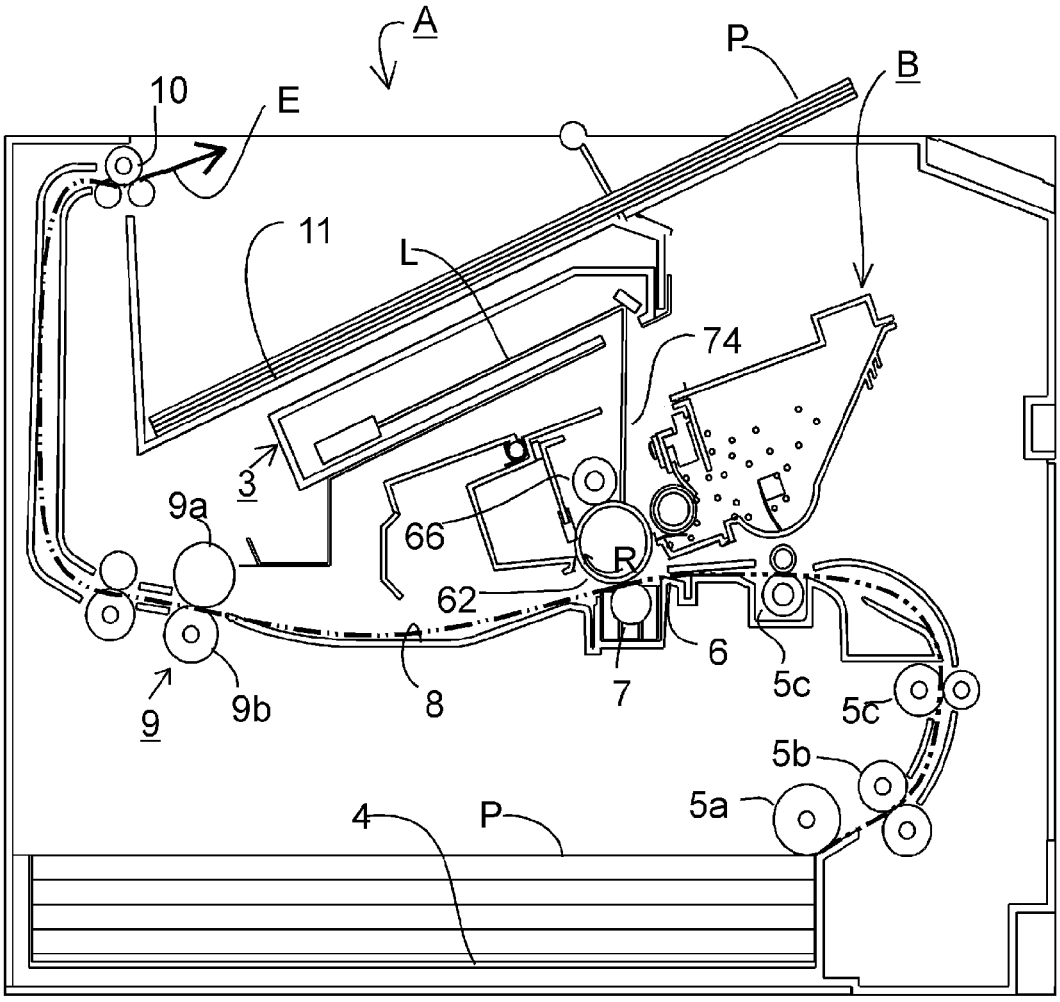
FIG. 2 is a principal sectional view an image forming apparatus according to the present invention.
Figure 3:
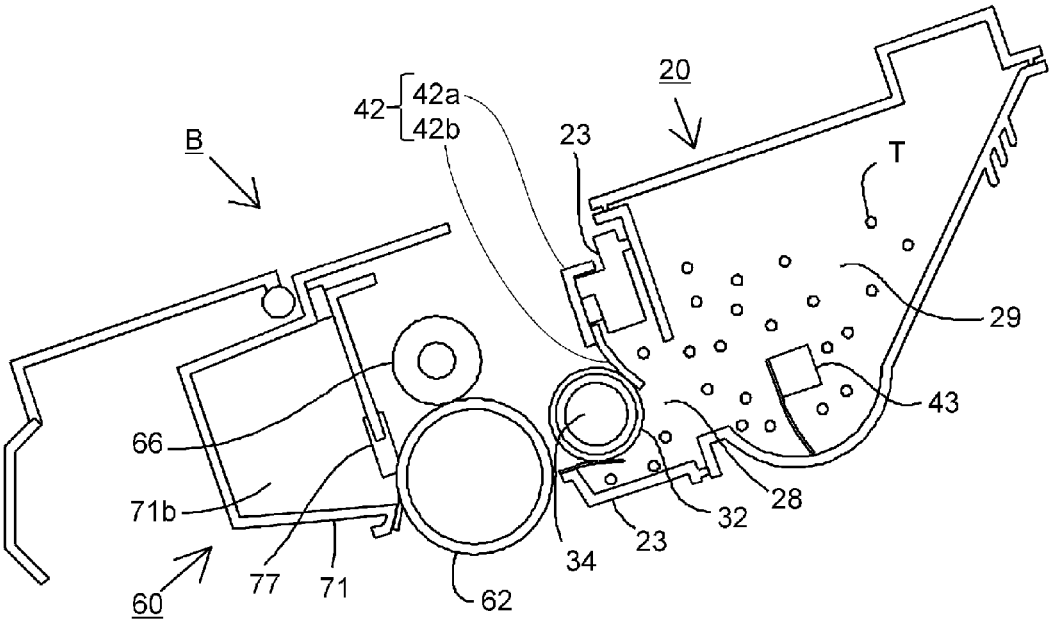
FIG. 3 is a principal sectional view of a process cartridge in the present invention.

With reference to FIGS. 2 and 3, a general structure and an image forming process of the image forming apparatus in this embodiment will be described. FIG. 2 is a schematic sectional view showing a structure of the image forming apparatus in this embodiment, and the image forming apparatus is constituted by an apparatus main assembly A and a process cartridge B. Here, the apparatus main assembly A is a structural portion constituted by removing the cartridge B from an apparatus constitution of the image forming apparatus.

<General Structure of Electrophotographic Image Forming Apparatus>

As shown in FIG. 2, the image forming apparatus according to this embodiment is a laser beam printer using an electrophotographic technique in which the cartridge B is detachably mountable to an apparatus main assembly of the image forming apparatus.

When the cartridge B is mounted in the apparatus main assembly A, above the process cartridge B, an exposure device 3 (laser scanner unit) is positioned. Further, below the cartridge B, a sheet (feeding) tray 4 in which a recording material (sheet material P) as an object to be subjected to image formation is accommodated is provided.

Further, in the apparatus main assembly A, along a feeding direction E of the sheet material P, a pick-up roller 5*a*, a feeding roller pair 5*b*, a conveying roller pair 5*c*, a transfer guide 6, a transfer roller 7, a conveying guide 8, a fixing device 9, a discharging roller pair 10, a discharge tray 11 and the like are successively provided.

<Image Forming Process>

On the basis of a print start signal, the drum 62 is rotationally driven at a predetermined peripheral speed (process speed) in an arrow R direction in FIG. 2. A charging roller 66 to which a charging bias voltage is applied contacts an outer peripheral surface of the drum 62 and electrically charges the outer peripheral surface of the drum 62 uniformly. The exposure device 3 outputs laser light 3*a* depending on image information. The laser light L passes through an exposure window portion 74 provided at an upper surface of the cartridge B, so that the outer peripheral surface of the drum 62 is subjected to scanning exposure. As a result, on the outer peripheral surface of the drum 62, an electrostatic latent image (electrostatic image) corresponding to the image information is formed.

On the other hand, as shown in FIG. 3, in a developing device unit 20 as a developing device, a toner T (developer) in a toner chamber 29 is stirred and fed by rotation of a feeding member 43, so that the toner T is sent to a toner supply chamber 28. The toner T is carried on a surface of the developing roller (developing sleeve) 32 by a magnetic force of a magnet roller 34 (fixed magnet). The toner T is regulated in layer thickness on a peripheral surface of the developing roller 32 by a developing blade 42 while being triboelectrically charged. The toner T is transferred onto the drum 62 depending on the electrostatic latent image, so that the electrostatic latent image is visualized (developed) as a toner image (developer image).

Further, as shown in FIG. 2, in synchronism with output timing of the laser light L, the sheet material P accommodated in the sheet tray 4 provided at a lower portion of the apparatus main assembly A is fed from the sheet tray 4. Then, the sheet material P is conveyed to a transfer position (transfer nip) between the drum 62 and the transfer roller 7 via the transfer guide 6. At this transfer position, the toner image is successively transferred from the drum 62 onto the sheet material P. The sheet material P on which the toner image is transferred is nipped and fed at a fixing nip formed between a heating member 9*a* and a pressing member 9*b* of the fixing device 9, and a pressure and heat fixing process is effected, so that the toner image is fixed on the sheet material P. The sheet material P on which the toner image is fixed is conveyed to the discharging roller pair 10 and then is discharged onto the discharge tray 11.

On the other hand, as shown in FIG. 3, the drum 62 after the transfer is, after a residual toner on the outer peripheral surface of the drum 62 is removed by a cleaning blade 77, used again in the image forming process. The residual toner removed from the drum 62 is stored in a residual toner chamber 71*b* of a cleaning unit 60.

In the above constitution, the charging roller 66, the developing roller 32, and the cleaning blade 77 are the process means actable on the drum 62.

<General Structure of Cartridge>

With reference to FIG. 3, a general structure of the cartridge B will be described.

The cartridge B is constituted by combining the cleaning unit 60 and the developing device unit 20. The cleaning unit 60 is constituted by a cleaning frame 71, the drum 62, the charging roller 66, the cleaning blade 77 and the like. On the other hand, the developing device unit 20 is constituted by a developing container 23, first and second side members (not shown), a developing blade 42, the developing roller 32, a magnet roller 34, the feeding member 43, the toner T, and the like. The cleaning unit 60 and the developing device unit 20 are rotationally movably connected with each other, so that the cartridge B is constituted.

<Structure of Cleaning Unit>

A structure of the cleaning unit 60 will be described with reference to FIG. 3. The cleaning blade 77 contacts the drum 62, so that the residual toner is removed from the outer peripheral surface of the drum 62. The removed toner is stored in the residual toner chamber 71*b* of the cleaning unit 60. The charging roller 66 is urged against the drum 62 and is rotated with rotation of the drum 62. The drum 62 is rotatably supported by the cleaning frame 71.

<Structure of Developing Device>

A structure of the developing device unit 20 will be described with reference to FIGS. 3 and 6. The developing blade 42 is constituted by a supporting member 42*a* formed with a metal plate and an elastic member 42*b* formed of an electric material such as a urethane rubber material, and is fixed at a predetermined position to the developing container 23 as an accommodating container for accommodating the developer by fixing longitudinal end portions of the supporting member 42*a* with screws 150. The elastic member 42*b* contacts the developing roller 32 which is a rotatable member provided rotatably at an opening of the developing container 23, and not only regulates (defines) a toner amount on the peripheral surface of the developing roller 32 but also imparts triboelectric charges to the toner.

<Developing Container and Sealing Member>

Figure 1:
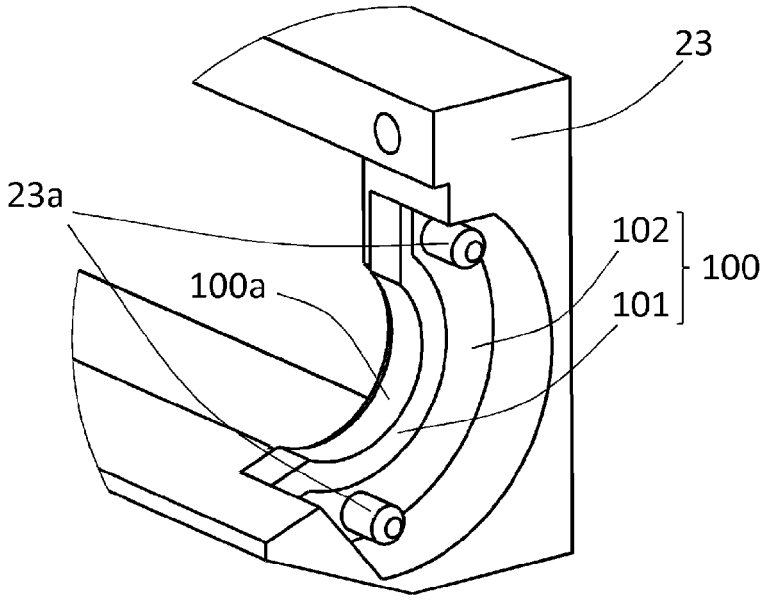
In FIG. 1, (a) and (b) are perspective views each showing a principal part of a sealing member and a periphery thereof in Embodiment 1 of the present invention.
Figure 1:
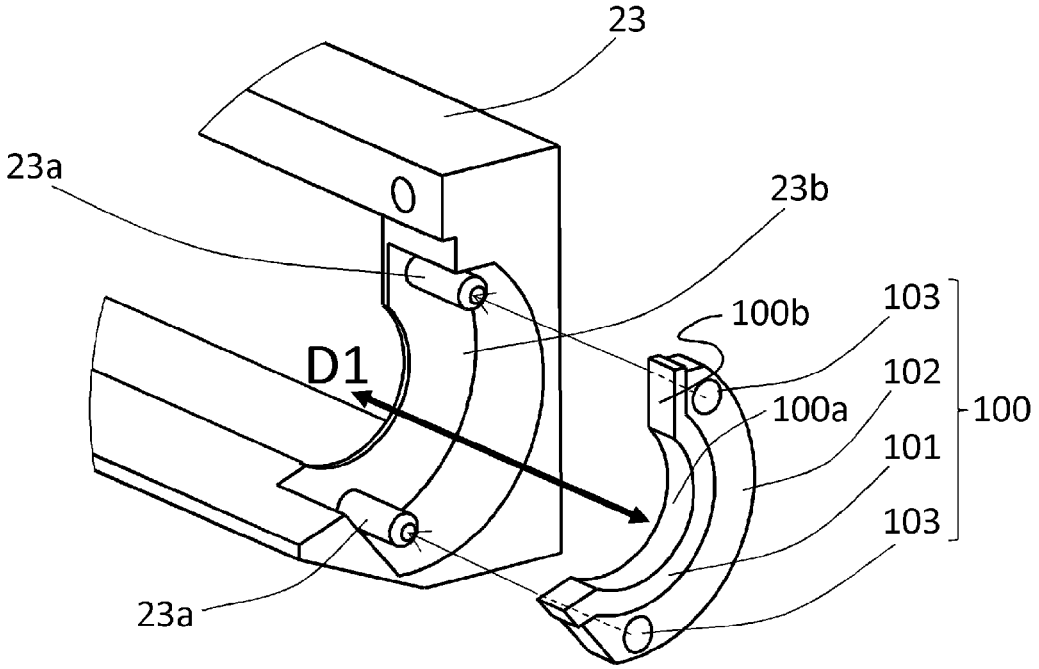
Figure 6:
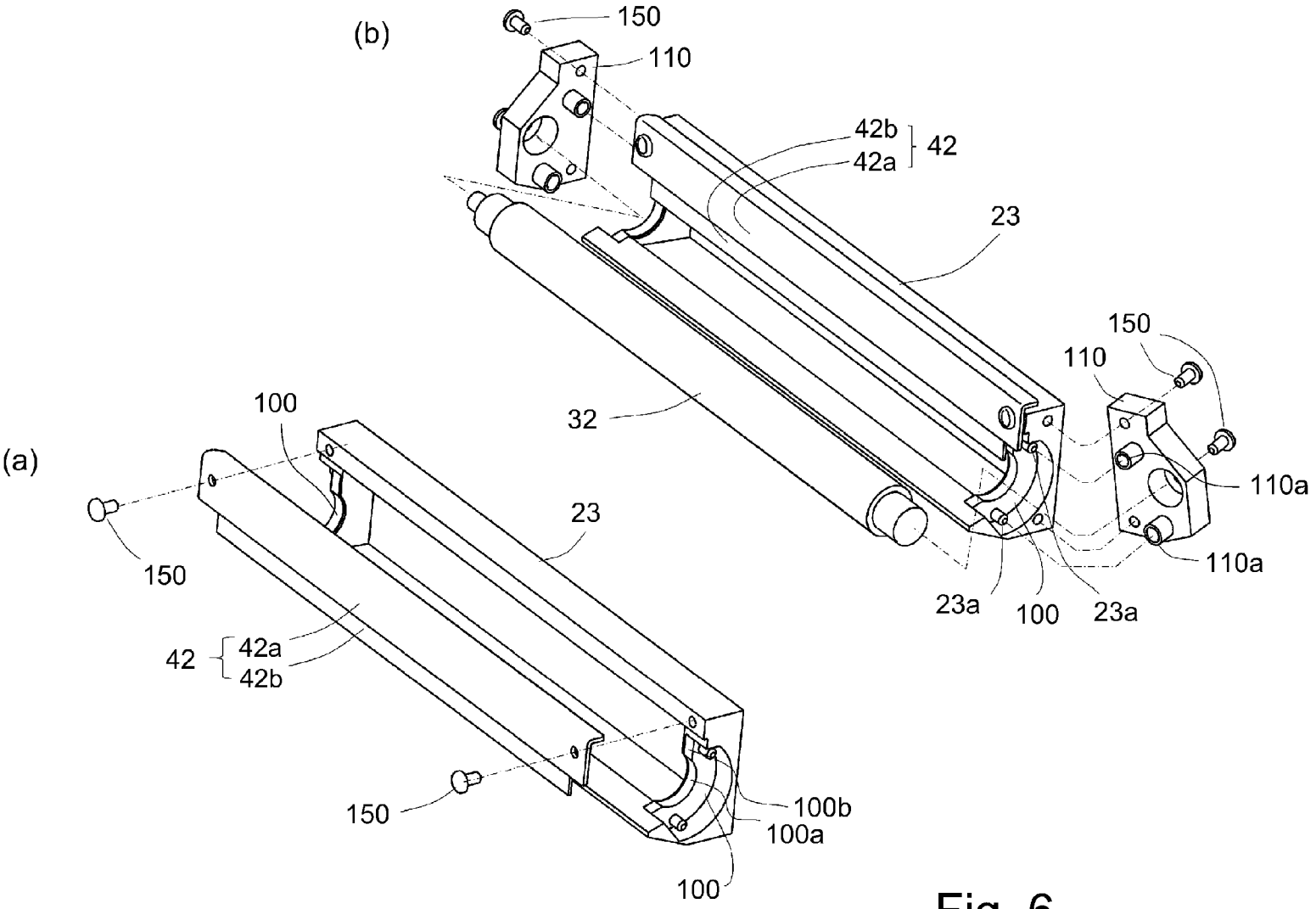
In FIG. 6, (a) and (b) are schematic views for illustrating an assembling constitution of a developing unit in the present invention.
Figure 11:
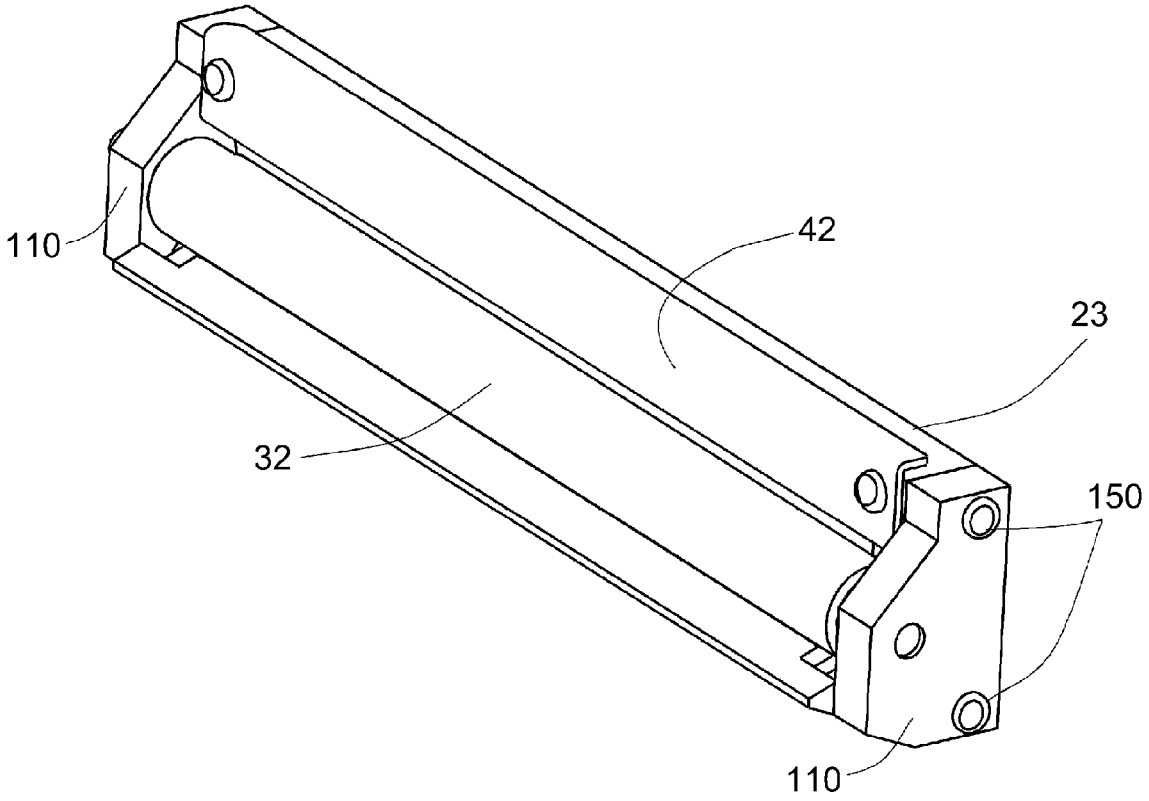
FIG. 11 is a perspective view of a structure of the developing unit in the present invention.

With reference to FIGS. 1, 6 and 11, a sealing member 100 according to this embodiment will be described. The sealing member 100 is seal member, provided at an end portion of the developing blade 42, for preventing leakage of the toner from an inside of the developing container 23. In FIG. 1, (a) is a schematic perspective view for illustrating a state after the sealing member 100 is accommodated to the developing container 23, and (b) is a schematic perspective view for illustrating a state before the sealing member 100 is assembled to the developing container 23. In FIG. 6, (a) is a schematic perspective view for illustrating a state when the developing blade 42 is assembled after the sealing member 100 is assembled, and (b) is a schematic perspective view for illustrating a state when the developing roller 32 and developing roller supporting members 110 are assembled after the developing blade 42 is assembled. FIG. 11 is a schematic perspective view for illustrating a state of the developing device unit 20 after the developing roller supporting members 110 are assembled.

As shown in FIG. 1, the sealing member 100 includes a seal forming portion 101 and a supporting portion 102. The seal forming portion 101 includes a developing roller sealing portion 100*a* (first surface) and a blade sealing portion 100*b* (third sealing portion). The developing roller sealing portion 100*a* contacts an outer peripheral surface of the developing roller 32 and prevents the developer on the developing roller 32 and in the developing container 23 from leaking out to an outside of the developing container 23. The blade sealing portion 100*b* contacts the developing blade 42 and prevents the developer in the developing container 23 from leaking out to the outside of the developing container 23. The supporting portion 102 is provided with holes 103 as an engaging portion, and bosses 23*a* as a portion-to-be-engaged are provided on the developing container 23 correspondingly to the holes 103. Each of the bosses 23*a* has a projected shape extending in a longitudinal direction (D1 direction), and one of the holes 103 is formed in such a shape that the hole 103 penetrates in the D1 direction. Assembling of the sealing member 100 to the developing container 23 is made by inserting the bosses 23*a* into the holes 103 and then by moving the sealing member 100 in the D1 direction. The sealing member 100 in this embodiment includes at least two holes 103*a* of which one hole is a round hole (circular hole) and another hole is an elongated hole for stopping rotation. Correspondingly to the holes 103*a*, also the developing container 23 includes at least two bosses 23*a*. By engagement of these holes 103*a* and bosses 23*a*, movement of the sealing member 100 toward the developing container 23 in a direction crossing the D1 direction is prevented. The sealing member 100 is assembled along the bosses 23*a* until the sealing member 100 abuts against a wall 23*b*, of the developing container 23, opposing the sealing member 100 with respect to the D1 direction. At this time, a side surface (second sealing portion), of the seal forming portion 101, contacting the wall 23*b* closely contacts the wall 23*b*, so that the side surface seals between the developing container 23 and the sealing member 100.

As shown in (a) of FIG. 6, after the sealing members 100 are assembled to the end portions of the developing container 23, the developing blade 42 is assembled. Then, as shown in (b) of FIG. 6, in order to support and hold the developing roller 32 at a predetermined position relative to the developing container 23, the developing roller supporting members 110 are moved in the D1 direction and are assembled. A state after the developing roller supporting members 110 are assembled is as shown in FIG. 1. Each of the developing roller supporting members 110 includes a shaft hole for shaft-supporting a shaft of the developing roller 32 and the engaging portions engageable with the portions-to-be-engaged 23*a* of the developing container 23, and is assembled with respect to the D1 direction so that the shaft of the developing roller 32 can be inserted into the shaft hole and so that the engaging portions can engage with the portions-to-be-engaged 23*a*.

The seal forming portion 101 of the sealing member 100 is constituted by an elastic member such as a rubber material, and a material of the supporting portion 102 is constituted by a material, harder than the material of the seal forming portion 101, such as a resin material or a metal material. Here, as the material used for the seal forming portion 101, thermoplastic elastomer resin materials such as those which are styrene-based, olefin-based, vinyl chloride-based, urethane-based, amide-based, and the like, and rubber materials such as natural rubber materials, synthetic rubber materials, and the like are suitable. Connection between the seal forming portion 101 and the supporting portion 102 may be made by bonding using an adhesive, an adhesive tape or the like or by engaging connection using a projected portion and a recessed portion or the like in view of manufacturing conveniences such as an amount of production and design conveniences such as a shape (not shown).

As described above, the sealing member 100 is constituted by the seal forming portion 101 which is the elastic member and the supporting member 102 harder than the seal forming portion 101, whereby the following effect is obtained. That is, in the case where the sealing member was formed of only a soft material as in a conventional constitution, deformation due to a weight of the sealing member itself and deformation due to gripping generated, so that it became difficult to assemble the sealing member to the drum 23 by fitting the sealing member to the drum 23 at a predetermined position in some cases. However, according to this embodiment, by the supporting portion 102 harder than the seal forming portion 101, an attitude of the seal forming portion 101 is maintained and thus the deformation of the sealing member 100 is suppressed, so that assembling of the sealing member 100 to a predetermined assembling position can be easily performed and thus an assembling property can be improved.

Figure 12:
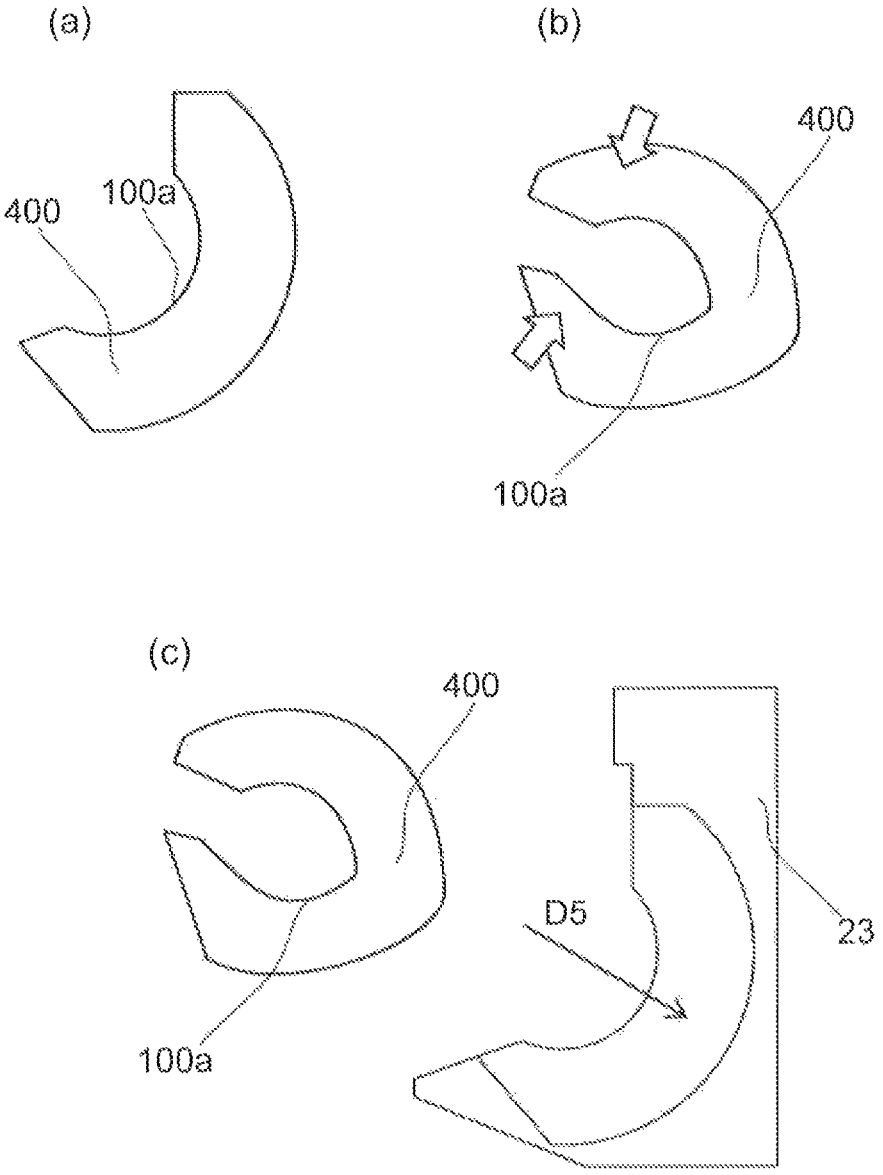
Fig. 12 PRIOR ART
In FIG. 12, (a) to (c) are schematic views for illustrating structures of a sealing member and a developing container in a conventional example.

In FIG. 12, (a) to (c) are schematic side views for illustrating assembling of a sealing member 400 in a conventional example. In FIG. 12, (a) shows a state of the sealing member 400 before deformation, (b) shows a state of the sealing member 400 when the sealing member 400 is deformed, and (c) shows a state of the sealing member 400 when the deformed sealing member 400 is assembled to the developing container 23. In the case where the conventional sealing member 400 having elasticity as shown in FIG. 12 is assembled from a direction D5 crossing the longitudinal direction (D1 direction), in some cases, it is difficult to assemble the sealing member 400 since the sealing member 400 cannot be assembled unless the sealing member 400 is deformed. On the other hand, in the constitution as described in this embodiment, it is possible to assemble the sealing member 100 to the developing container 23 (FIG. 1) without requiring deformation of the sealing member 100 as the case of the conventional example described above.

As described above, in this embodiment, the constitution in which the sealing member 100 is assembled to the developing container 23 along the longitudinal direction (D1 direction) is employed, so that compared with the conventional example, improvement of the assembling property is realized. That is, in this embodiment, the constitution in which the sealing member 100 can be assembled to the developing container 23 without causing the deformation is employed. As a result, it becomes possible to constitute the sealing member with a member of a hard material which does not readily cause the deformation. That is, the sealing member 100 can be constituted by the seal forming portion 101 formed with a soft (easily deformable) elastic member for ensuring a sealing property and by the supporting portion 102 formed of the material, such as the resin material or the metal material, harder than the material of the seal forming portion 101. Further, also in the constitution in which the sealing member is assembled to the developing container in one direction as in this embodiment, a degree of the improvement of the assembling property in the constitution in which the soft sealing portion is supported by the hard supporting portion as in this embodiment is more than a degree of the improvement of the assembling property in the conventional constitution in which the sealing member is formed with only the elastic member. That is, gripping of the sealing member during the assembling is not performed by the soft sealing portion which is liable to change in attitude by deformation, but is performed by the hard supporting portion capable of gripping the sealing member in a stable attitude, so that assembling of the sealing member to the developing container can be facilitated.

[Embodiment 2]

A sealing member 100 according to Embodiment 2 of the present invention is characterized in that a seal forming portion 101 and a supporting portion 102 are molded by an integral molding method such as two-color molding (coinjection molding) or insert molding. Here, the two-color molding is such a method that either one of the seal forming portion 101 and the supporting portion is molded with a first material in advance and then a second material is molded while leaving the molded portion in a metal mold. Further, the insert molding is such a method that the portion molded in advance is placed in a separate mold and the second material is then molded. As another method, the sealing member may also be molded by various molding methods capable of integrally molding the seal forming portion 101 and the supporting portion 102 with different materials. Particularly, according two-color molding, the seal forming portion 101 and the supporting portion 102 can be molded at one time, so that cost reduction can be realized.

[Embodiment 3]

Embodiment 3 of the present invention will be described with reference to FIGS. 1, 4, 5 and 7. Embodiment 3 is characterized by assembling and seal constitution between a developing container 23 and a sealing member 100. In this embodiment, constitutions common to Embodiments 1 to 3 are represented by the same reference numerals or symbols and will be omitted from redundant description. In this embodiment, matters where are not described below are similar to those in the above-described embodiments.

Figure 4:
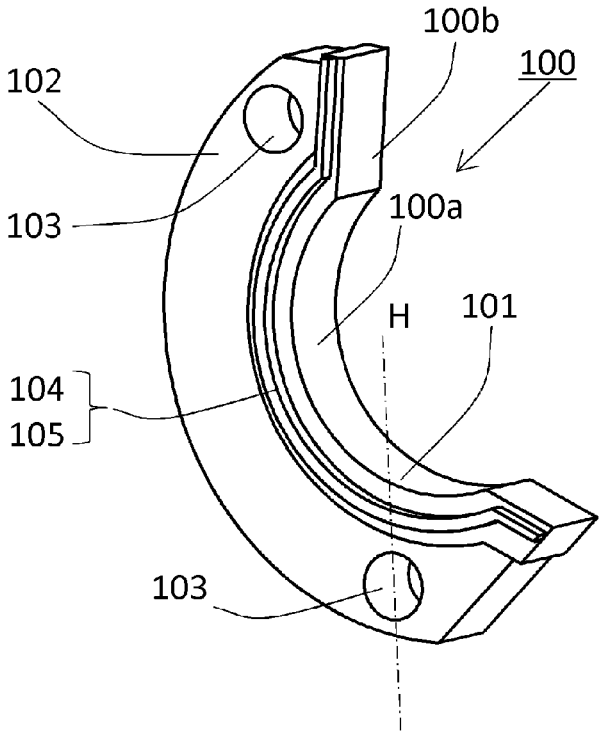
FIG. 4 is a perspective view of a sealing member in Embodiment 3.
Figure 5:
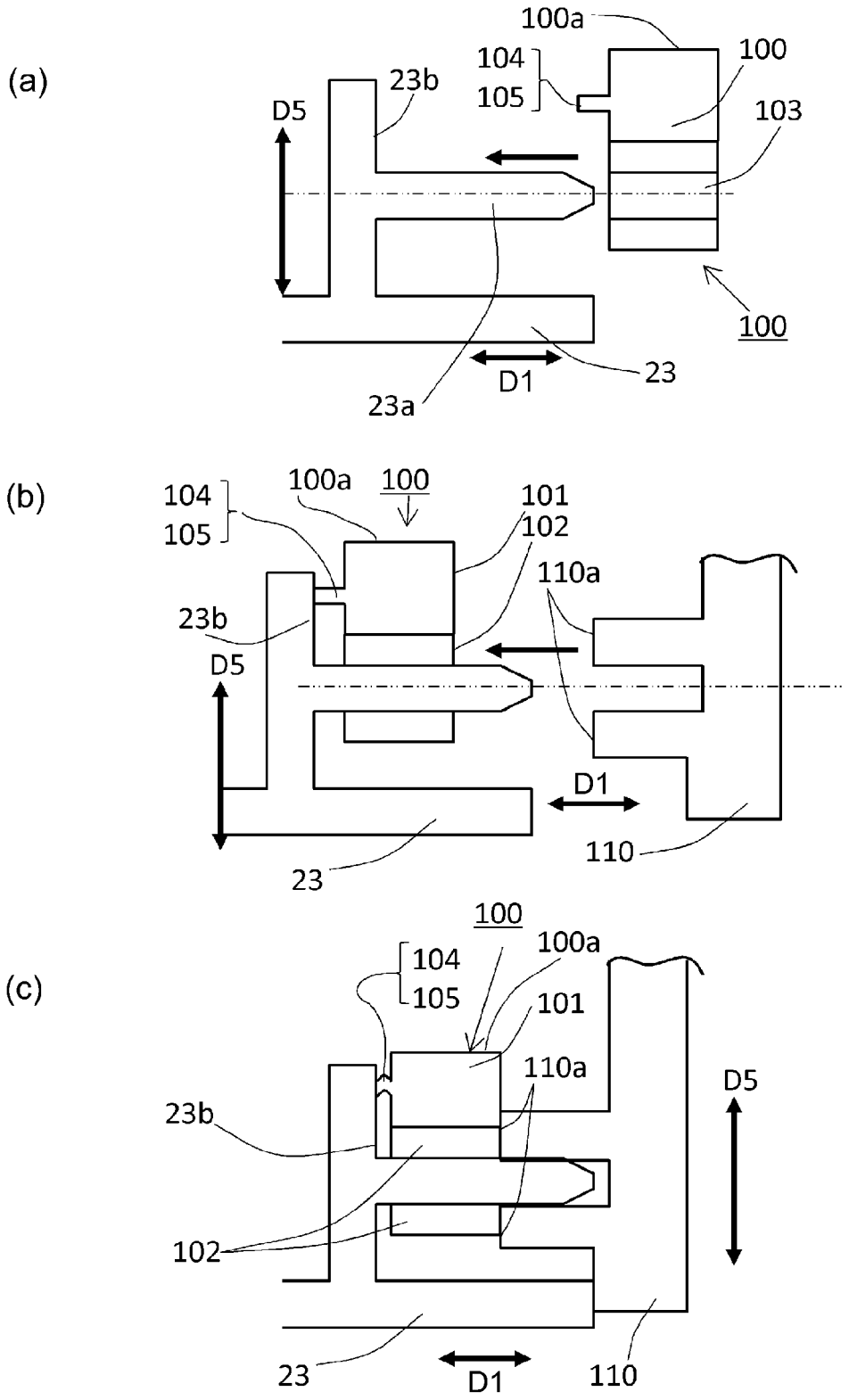
In FIG. 5, (a) to (c) are sectional views each showing the sealing member and a periphery thereof in Embodiment 3.
Figure 7:
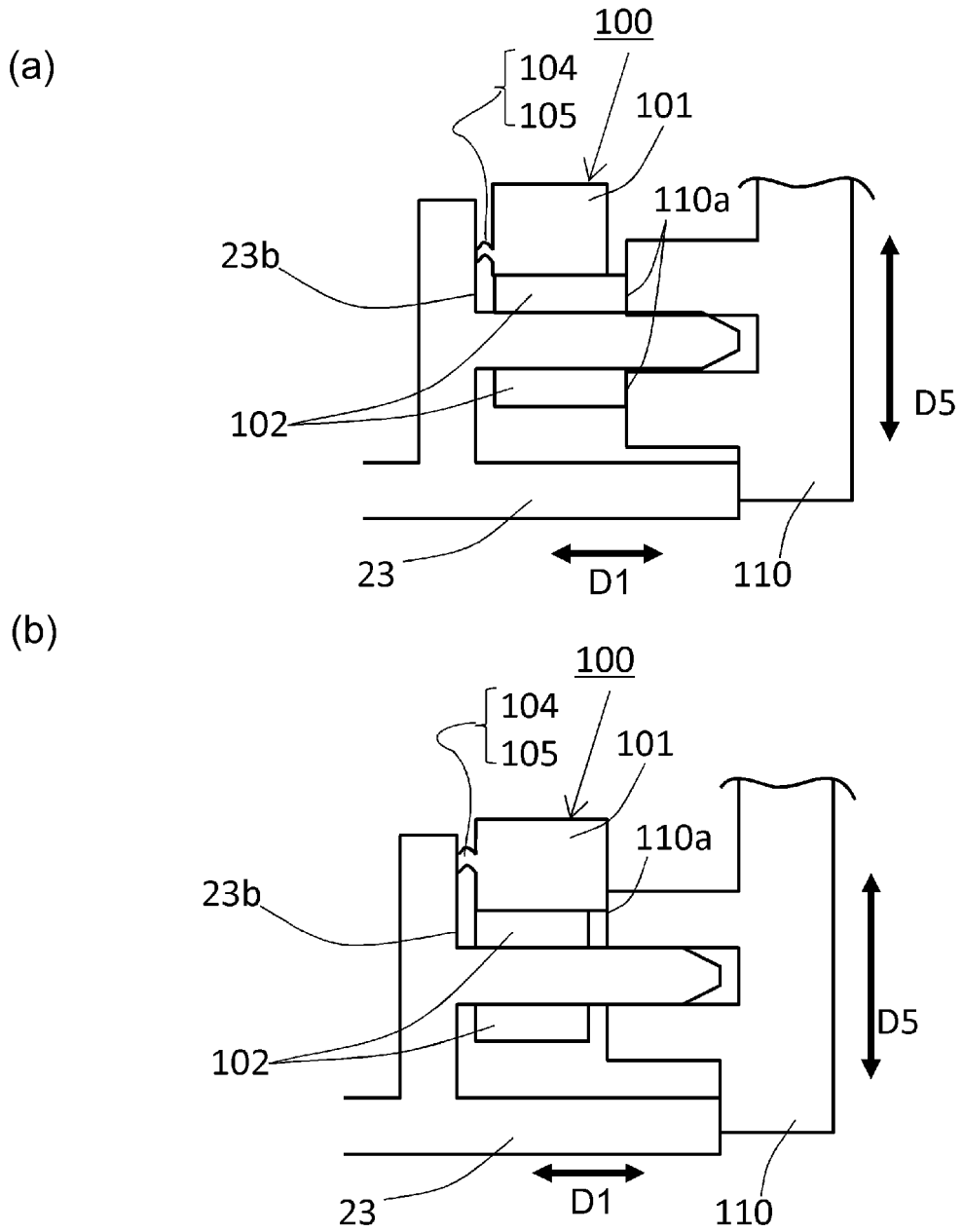
In FIG. 7, (a) and (b) are sectional views of sealing members and peripheries thereof in Modified Embodiments 1 and 2, respectively, of Embodiment 3.

FIG. 4 is a schematic perspective view for illustrating a structure of the sealing member 100 according to this embodiment. In FIG. 5, (a) to (c) are schematic sectional views each showing a cross section taken along a chain line H in FIG. 4, wherein (a) shows a state before the sealing member 100 is assembled to the developing container 23, (b) shows a state after the sealing member 100 is assembled to the developing container 23 and before a developing roller supporting member 110 is assembled to the developing container 32, and (c) shows a state after the developing roller supporting member 110 is assembled to the developing container 23. In FIG. 7, (a) and (b) are schematic sectional views, each showing a constitution of a modified embodiment of Embodiment 3, corresponding to cross sections taken along the chain line H in FIG. 4, and each shows a state after not only the sealing member 100 but also the developing roller supporting member 110 are assembled to the developing container 23. In FIG. 7, (a) shows Modified Embodiment 1 and (b) shows Modified Embodiment 2.

As shown in FIG. 1 and (a) of FIG. 5, also in this embodiment, similarly as in Embodiment 1, the sealing member 100 is moved in the D1 direction and is assembled to the developing container 23. Then, as shown in (b) of FIG. 5, the sealing member 100 is inserted in the D1 direction until the sealing member 100 abuts against a wall 23*b* provided perpendicular to the D1 direction in the developing container 23. By a side portion (side sealing portion 105, second sealing portion) abutting against the wall 23*b* of the developing container 23, a portion between the developing container 23 and the sealing member 100 is sealed. Then, as shown in (c) of FIG. 5, the developing roller supporting member 110 is assembled to the developing container 23 from an outside along the D1 direction.

Here, the developing roller supporting member 110 includes an urging portion 110*a* for urging the sealing member against the wall 23*b* in the longitudinal develop (D1 direction). That is, the developing roller supporting member 110 has not only a function of supporting the developing roller 32 but also a function as an urging member for urging the sealing member 100 against the developing container 23 to improve a close contact property between the sealing member 100 and the developing container 23.

As shown in FIG. 4, the sealing member 100 includes a deformable portion 104 which is deformable by reaction force received from the wall 23*b* of the developing container 23 by being urged by the developing roller supporting member 110. Here, the deformable portion 104 also functions as the side sealing portion 105 which is the sealing portion for sealing between the sealing member 100 and the developing container 23, and is constituted by a rib-shaped projected portion projected from a side surface of the sealing member 100 in an opposing direction (D1 direction) to the wall 23*b*. The rib-shaped deformable portion 104 (side sealing portion 105) is formed along an edge of the side surface of the sealing member 100 so that the deformable portion 104 can seal among the developing container 23, the developing roller 32 and the developing blade 42 in order to suppress leakage of the developer from an inside to an outside of the developing container 23. Then, as shown in FIG. 6, the developing roller supporting member 110 is assembled to each of both end portions of the developing roller 23, and thereafter is fixed to the developing container 23 by screws 150.

In this way, using the developing roller supporting member 110 provided with the urging portion 110*a*, the sealing member 100 can be retained in a state in which the side sealing portion 105 is urged against the wall 23*b* in the longitudinal direction (D1 direction). That is, a sealing state between the sealing member 100 and the developing container 23 can be retained. Further, with respect to the longitudinal direction (D1 direction), a manufacturing tolerance generates in each of "a width of the sealing member 100" and "a distance of a gap between the wall 23*b* and the urging portion 100*a*". An amount corresponding to this tolerance can be absorbed by compression deformation of the deformable portion 104 which also functions as the side sealing portion 105. Incidentally, in order to cause the deformable portion 104 to exhibit a tolerance absorbing function, shapes and dimensions of respective members are set so that the urging portion 110 can always compress the deformable portion 104. According to this embodiment, by providing the deformable portion 104, it becomes possible to prevent leakage of the developer among the sealing member 100, the wall 23*b* and the urging portion 100*a* with respect to the longitudinal direction (D1 direction) and alleviation of manufacturing accuracy.

Incidentally, in this embodiment, a constitution in which the developing roller supporting member 110 exhibits the function of supporting the developing roller 32 and the function of urging the sealing member 100 against the developing container 23 by itself as a single member is employed. However, these two functions may also be constituted so as to be exhibited by separate members, respectively, prepared by functionally dividing the developing roller supporting member 110 into two members. That is, in this embodiment, a constitution in which a free end surface of the engaging portion (cylindrical projected portion) of the developing roller supporting member to be engaged with the portion-to-be-engaged 23*a* of the developing container 23 functions as the urging portion 100*a* is employed, but a constitution for urging the sealing member may also be provided separately from the engaging portion.

Further, in this embodiment, a constitution in which both of the seal forming portion 101 and the supporting portion 102 are urged by the urging portion 110*a* as shown in FIG. 5 is employed, but the present invention is not limited thereto. For example, as in Modified Embodiment 1 shown in (a) of FIG. 7, a constitution in which a dimension of the supporting portion 102 with respect to the D1 direction is made larger than that of the seal forming portion 101 with respect to an outward direction so that a portion urged by the urging portion 110*a* is the supporting portion 102 may also be employed. Or, as in Modified Embodiment 2 shown in (b) of FIG. 7, a constitution in which a dimension of the seal forming portion 101 with respect to the D1 direction is made larger than that of the supporting portion 102 with respect to an outward direction so that a portion urged by the urging portion 110*a* is the seal forming portion 101 may also be employed.

[Embodiment 4]

Embodiment 4 of the present invention will be described with reference to FIGS. 8, 9 and 10. Embodiment 4 is characterized by assembling and seal constitution between a developing container 23 and a sealing member 100. In this embodiment, constitutions common to Embodiments 1 to 4 are represented by the same reference numerals or symbols and will be omitted from redundant description. In this embodiment, matters where are not described below are similar to those in the above-described embodiments.

Figure 8:
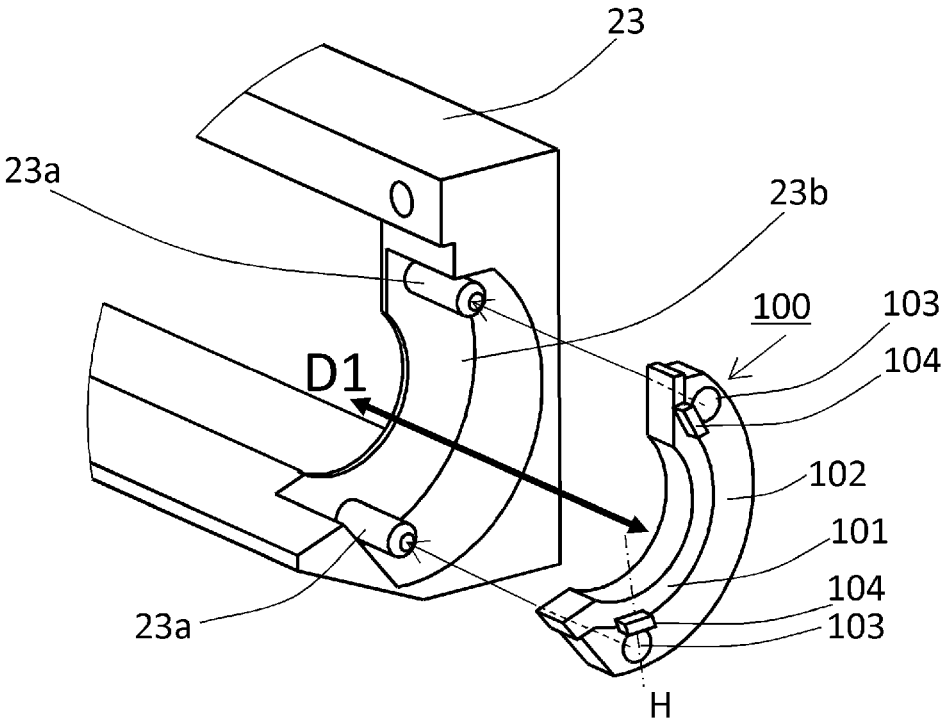
FIG. 8 is a perspective view of a sealing member and a periphery thereof in Embodiment 4.

FIG. 8 is a schematic perspective view for showing a state of the sealing member 100 before being assembled to the developing container 23. In FIG. 9, (a) and (b) are schematic sectional views each showing a cross section taken along a chain line H in FIG. 4, wherein (a) shows a state before the sealing member 100 is assembled to the developing container 23, and (b) shows a state after the sealing member 100 is assembled to the developing container 23. In FIG. 10, (a) and (b) are schematic sectional views, each showing a constitution of a modified embodiment of Embodiment 4, corresponding to cross sections taken along the chain line H in FIG. 4, and each shows a state after the developing roller supporting member 110 is assembled to the developing container 23. In FIG. 10, (a) shows Modified Embodiment 3 and (b) shows Modified Embodiment 4.

Figure 9:
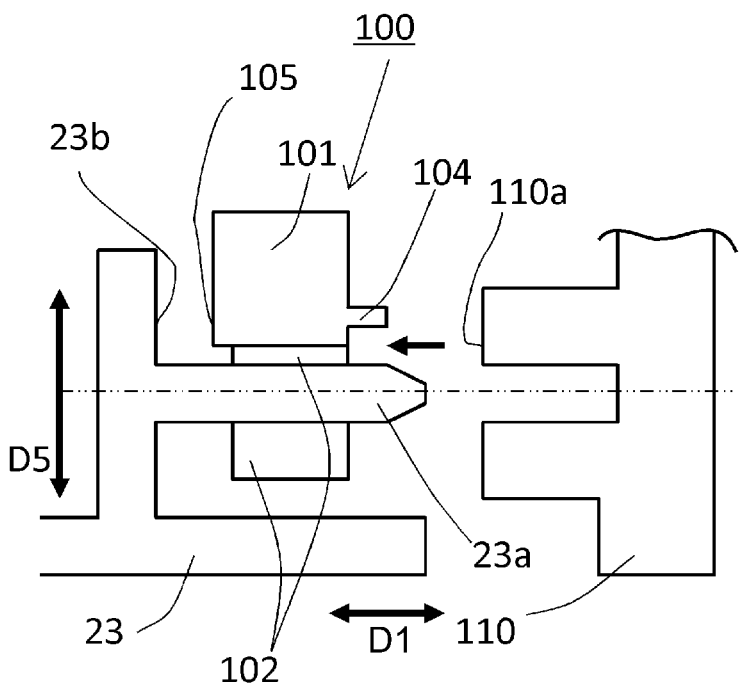
In FIG. 9, (a) and (b) are sectional views each showing the sealing member and the periphery thereof in Embodiment 4.
Figure 9:
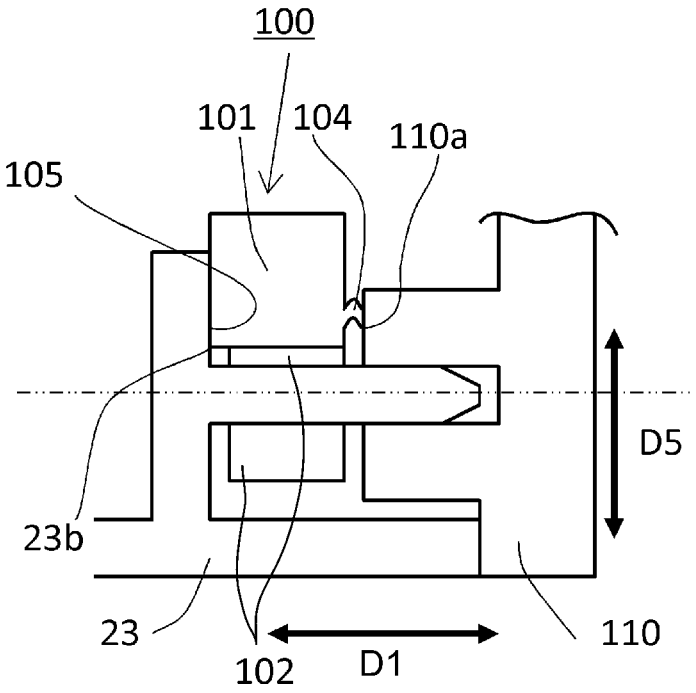

As shown in FIG. 8, also in this embodiment, similarly as in Embodiment 1, the sealing member 100 is provided with a deformable portion 104, but in this embodiment, the deformable portion 104 is provided on the sealing member 100 at the developing roller supporting member 110 side with respect to the D1 direction (FIG. 9). As shown in (b) of FIG. 9, the deformable portion 104 is deformed by being urged by the urging portion 110*a* by assembling of the developing roller supporting member 110 for urging the sealing member 100. Here, with respect to the D1 direction, a side surface, of the sealing member 100, opposite from the side surface where the deformable portion 104 is provided contacts and closely adheres to the wall 23*b* of the developing container 23, as the side sealing portion 105 (second sealing portion), and thus seals between the sealing member 100 and the developing container 23.

Here, as shown in (b) of FIG. 9, with respect to the D1 direction, such an arrangement that the positions of the deformable portion 104 and the side sealing portion 105 overlap with each other is employed. By such an arrangement, an elastically repelling force, of the deformable portion 104, generated by compression deformation due to urging by the urging portion 110*a* directly (linearly) acts on the side sealing portion 105, i.e., an urging force of the urging portion 110*a* can be linearly transmitted to the side sealing portion 105. As a result, the side sealing portion 105 can be urged against the wall 23*b* with a high degree of efficiency, so that further prevention of the leakage of the developer and further alleviation of the manufacturing accuracy can be realized. Further, as shown in 8*b*) of FIG. 9, in this embodiment, the deformable portion 104 and the side sealing portion 105 are provided separately on the opposite surfaces of the sealing member 100. That is, the deformable portion 104 in Embodiment 3 also functions as the side sealing portion 105, but the deformable portion 104 in this embodiment (Embodiment 4) has a constitution for transmitting the urging force of the urging portion 110*a* to the side sealing portion 105 (i.e., a constitution for forming a compression deformation state (elastically repelling force) by the urging force with reliability). As a result, the side sealing portion 105 is urged at a surface thereof against the developing container 23 without generating a large deformation as in the case of the deformable portion 104 and can seal between the sealing member 100 and the developing container 23. Accordingly, the sealing property between the sealing member 100 and the developing container 23 is further improved.

Figure 10:
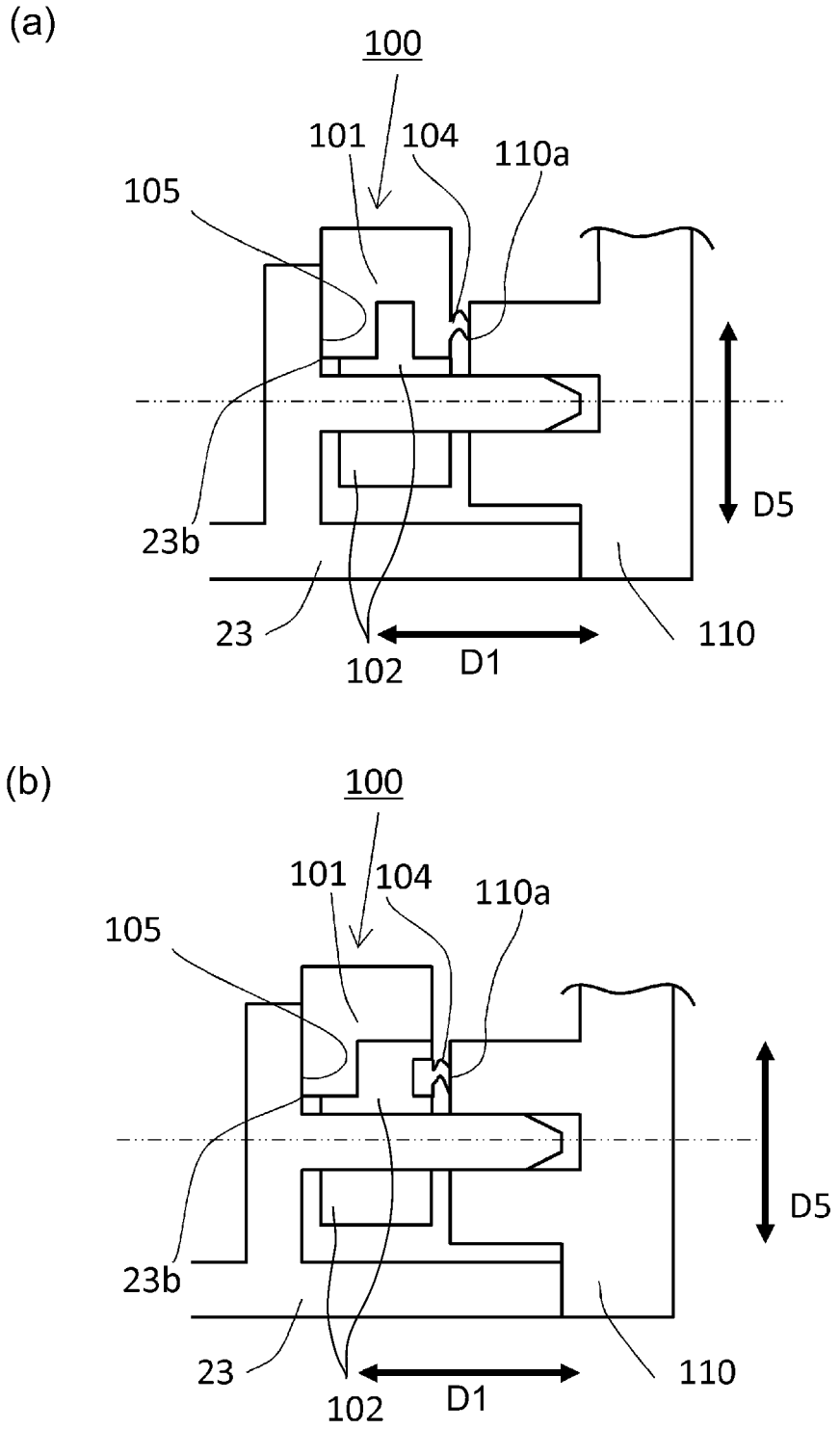
In FIG. 10, (a) and (b) are sectional views of sealing members and peripheries thereof in Modified Embodiments 3 and 4, respectively, of Embodiment 4.

Further, as in Modified Embodiment 3 shown in (a) of FIG. 10, a constitution in which the deformable portion 104, the side sealing portion 105 and the supporting portion 102 overlap with each other linearly with respect to the D1 direction by projecting a part of the supporting portion 102 in a D5 direction may also be employed. By employing such an overlapping constitution, the urging force of the side sealing portion 105 can be transmitted linearly, whereby the side sealing portion 105 can be urged against the wall 23*b* with a high degree of efficiency. Further, on a line where the urging force is transmitted, by the presence of the supporting portion 102 as a strength member, excessive deformation of an entirety of the sealing member 100 by the transmission of the urging force can be suppressed.

Further, as in Modified Embodiment 4 shown in (b) of FIG. 10, a constitution in which the deformable portion 104 is separated from the seal forming portion 101 may also be employed. That is, the constitution is such that the deformable portion 104 which is formed of an elastic member such as elastomer resin material or a rubber material similarly as in the case of the seal forming portion 101 and which is supported by the supporting portion 102 and is compression-deformed in the D1 direction by contact with the developing roller supporting member 110 is provided as a separate member from the seal forming portion 101. In the case of this constitution, the deformable portion 104 may also be constituted by a material which is softer than the material of the supporting portion 102 and which is different from the material of the seal forming portion 101. According to this constitution, it is possible to prevent the influence of deformation of the deformable portion 104 on another portion (particularly another sealing portion) of the sealing member 100.

(Other Modified Embodiments)

Figure 13:
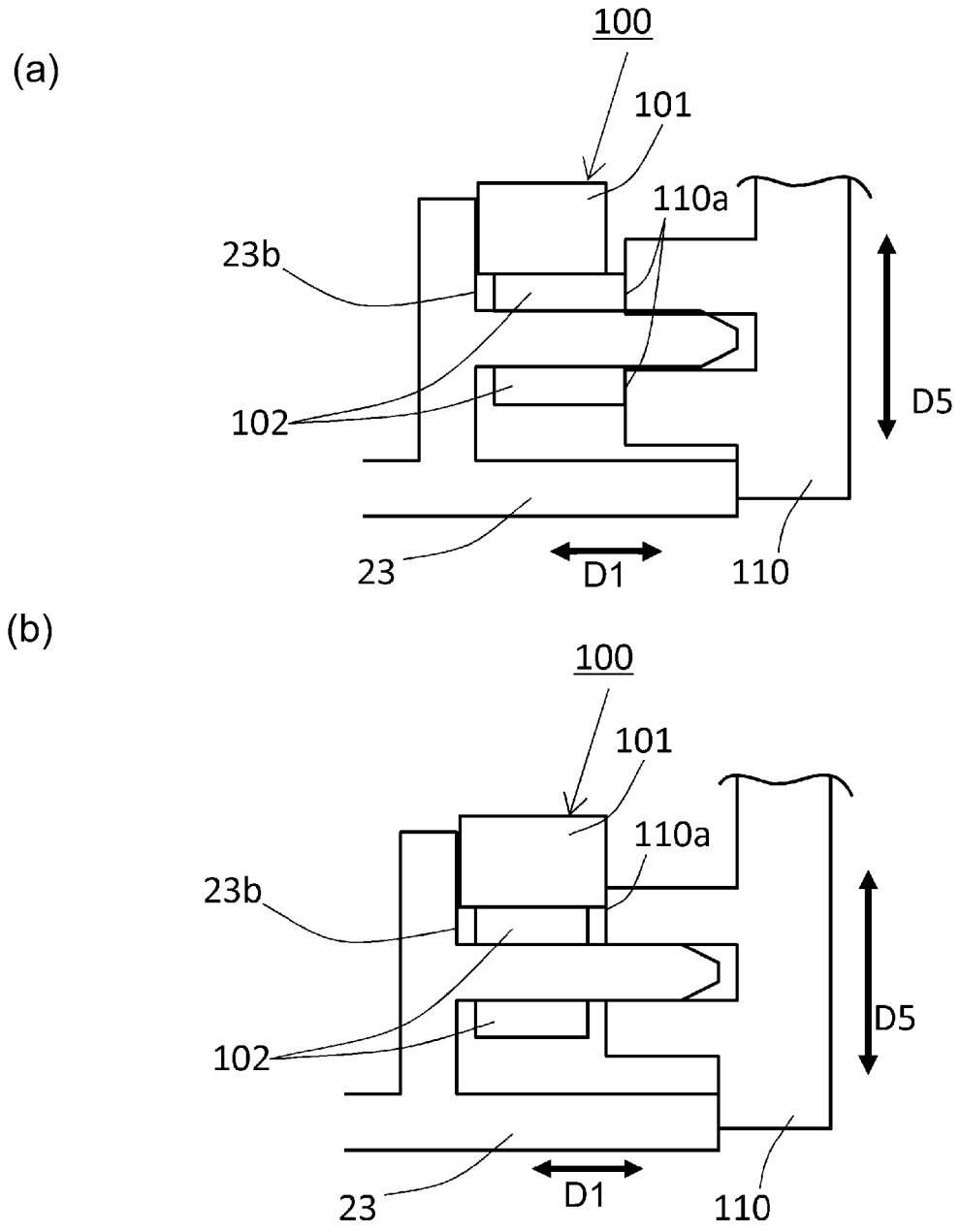
In FIG. 13, (a) and (b) are sectional views of sealing members and peripheries thereof in Modified Embodiments 5 and 6, respectively, of Embodiment 4.

In FIG. 13, (a) and (b) are schematic sectional views, each showing a constitution of a modified embodiment of Embodiment 1, corresponding to cross sections taken along the chain line H in FIG. 8, and each shows a state after the developing roller supporting member 110 are assembled to the developing container 23. In FIG. 13, (a) shows Modified Embodiment 5 and (b) shows Modified Embodiment 6.

As in Modified Embodiment 5 shown in (a) of FIG. 13, a constitution in which the seal forming portion 101 of the sealing member 100 is formed with a soft elastic member which is easily compression-deformed and an entirety of the seal forming portion 101 also functions as the deformable portion 104 may also be employed. That is, similarly as in Modified Embodiment 1 shown in (a) of FIG. 7, the constitution in which the dimension of the supporting portion 102 with respect to the D1 direction is made larger than that of the seal forming portion 101 in the outward direction and the portion urged by the urging portion 110*a* is the supporting portion 102 is employed. In addition thereto, in Modified Embodiment 5, a constitution in which an entirety of a side surface of the seal forming portion 101 contacts the wall 23*b* is employed. According to this constitution, the sealing member 100 contacts, at an entirety of the seal forming portion 101, the wall 23*b* of the developing container 23 in order to suppress leakage of the developer from the inside to the outside of the developing container 23 and thus is deformed. That is, the entirety of the seal forming portion 101 can function as not only the deformable portion 104 but also the side sealing portion 105 which is a sealing portion, of the sealing member 100, between the sealing member 100 and the developing container 23.

As in Modified Embodiment 6 shown in (b) of FIG. 13, a constitution in which the seal forming portion 101 of the sealing member 100 is formed with a soft elastic member which is easily compression-deformed and a dimension of the seal forming portion 101 with respect to the D1 direction is made larger than that of the supporting portion 102 with respect to an outward direction and an inward direction may also be employed. As a result, similarly as in Modified Embodiment 5, an entirety of the seal forming portion 101 can be caused to also function as the deformable portion 104 and the side sealing portion 105. That is, similarly as in Modified Embodiment 2 shown in (b) of FIG. 7, the constitution in which the dimension of the seal forming portion 101 with respect to the D1 direction is made larger than that of the supporting portion 102 in the outward direction and the portion urged by the urging portion 110*a* is the seal forming portion 101 is employed. In addition thereto, a constitution in which also the dimension of the seal forming portion 101 with respect to the D1 direction is made larger than that of the supporting portion 102 also in the inward direction and in which the seal forming portion 101 contacts the wall 23*b* is employed. According to this constitution, an entirety of the seal forming portion 101 is compression-deformed between the urging portion 110*a* and the wall 23*b* by urging by the urging portion 110*a* and by the reaction force from the wall 23*b* of the developing container 23 in order to suppress leakage of the developer from the inside to the outside of the developing container 23. That is, the entirety of the seal forming portion 101 can function as not only the deformable portion 104 but also the side sealing portion 105 which is a sealing portion, of the sealing member 100, between the sealing member 100 and the developing container 23.

In the above-described embodiments, respective constitutions can be combined with each other to the possible extent. For example, a constitution in which the side sealing portion 105 formed by the entirety of the side surface of the seal forming portion 101 in Embodiment 4 is changed to the rib-projection-shaped side sealing portion 105 also functioning as the deformable portion in Embodiment 3 and in which the deformable portion is provided on each of both sides with respect to the axial direction may also be employed.

Further, the above-described embodiments are described as examples to which the present invention is applied, with respect to the sealing member of the developing unit, but a constitution to which the present invention is applicable is not limited to the above-described embodiments. For example, the present invention is also applicable to a sealing constitution for preventing leakage of a residual toner from a residual toner container 71*b* in a cleaning unit, i.e., a sealing member, provided on the cleaning frame 71, contacting or sliding with the cleaning blade 77 or the photosensitive drum 62.

Further, the constitutions between the portions-to-be-engaged and the engaging portions described in the above-described embodiments, i.e., the engaging constitutions between the developing container 23 and the sealing member 100 are not limited to the above-described constitutions. For example, the engaging constitution by mutual engagement between the projected shape and the recessed shape may also be replaced with an opposite constitution thereto in each of the above-described embodiments, i.e., a constitution in which the projected portion projecting in the D1 direction is provided on the sealing member 100 and the recessed portion engageable with the projected portion is provided on the developing container 23. Further, in the above-described embodiments, the constitution in which the supporting portion 102 is provided with the hole 103 as the engaging portion is employed, but the sealing portion 101 may also be provided with a through hole or a hole as the engaging portion, and each of the supporting portion 102 and the sealing portion 101 may also be provided with the through hole or the hole as the engaging portion.

Further, in the above-described embodiments, only the sealing constitution at one of the both end portions of the developing roller 32 with respect to the axial direction was described, but also the sealing constitution on the other end portion is similarly constituted. That is, the sealing constitution on the other end portion only has a symmetrical (opposite) relationship, in arrangement (constitution) or the like with respect to the axial direction, with the one of the both end portions, and is not different in function or the like from the one of the both end portions.

According to the present invention, it is possible to improve the assembling property of the sealing member to the developing container.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-132104 filed on Jun. 30, 2015, which is hereby incorporated by reference herein in its entirety.

What is claimed is:

1. A sealing member for sealing between an accommodating container for accommodating a developer and a rotatable member to be rotatably assembled to the accommodating container, said sealing member comprising:

a seal portion formed of an elastomer resin material or a rubber material and configured to be closely contacted to each of the accommodating container and the rotatable member; and a supporting portion for supporting said seal portion, wherein said supporting portion is formed of a material harder than the material of said seal portion and is configured to be fixed to the accommodating container, wherein said seal portion includes (i) a first sealing portion closely contacting a peripheral surface of said rotatable member, (ii) a second sealing portion contacting the accommodating container in an axial direction of a rotation shaft of the rotatable member, and (iii) a deformable portion, capable of compression deformation in the axial direction such that the second sealing portion contacts the accommodating container when said supporting portion is fixed to the accommodating container, said deformable portion being projected to the axial direction compared to the supporting portion.

2. A sealing member according to claim 1, wherein said sealing member is fixed to the accommodating container by being pressed against the accommodating container with respect to the axial direction by a fixing member, which is assembled to the accommodating container with respect to the axial direction, for rotatably supporting an end portion of said rotatable member with respect to the axial direction.

3. A sealing member according to claim 2, wherein said seal portion contacts the fixing member.

4. A sealing member according to claim 2, wherein said supporting portion contacts the fixing member.

5. A sealing member according to claim 2, wherein said deformable portion is capable of compression deformation with respect to the axial direction by urging of the fixing member.

6. A sealing member according to claim 5, wherein said deformable portion contacts the fixing member.

7. A sealing member according to claim 2, wherein said second sealing portion is capable of compression deformation with respect to the axial direction by urging of the fixing member.

8. A sealing member according to claim 2, wherein said supporting portion includes, with respect to the axial direction, a portion interposed between a portion contacting the fixing member at said seal portion and said second sealing portion.

9. A sealing member according to claim 2, further comprising a recessed portion with which a projected portion, provided on the accommodating container, projecting in the axial direction is engageable, and wherein said sealing member is assembled to the accommodating container with respect to the axial direction.

10. A sealing member according to claim 9, wherein said recessed portion, provided in said supporting portion, penetrates through said supporting portion with respect to the axial direction.

11. A sealing member according to claim 2, wherein said supporting portion includes a portion interposed between said deformable portion and said second sealing portion of said seal forming portion with respect to the axial direction.

12. A sealing member according to claim 1, wherein said seal portion and said supporting portion are molded by two color molding.

* * * * *